US011431132B2

(12) United States Patent
Teruki et al.

(10) Patent No.: US 11,431,132 B2
(45) Date of Patent: Aug. 30, 2022

(54) CONNECTOR ASSEMBLY

(71) Applicant: Molex, LLC, Lisle, IL (US)

(72) Inventors: Satoru Teruki, Yamato (JP); Sho Kitazawa, Yamato (JP); Akihiko Okajima, Yamato (JP); Toshitaka Kusuhara, Yamato (JP)

(73) Assignee: MOLEX LLC, Lisle, IL (US)

( * ) Notice: Subject to any disclaimer, the term of this patent is extended or adjusted under 35 U.S.C. 154(b) by 0 days.

(21) Appl. No.: 17/062,639

(22) Filed: Oct. 5, 2020

(65) Prior Publication Data

US 2021/0057852 A1 Feb. 25, 2021

Related U.S. Application Data

(63) Continuation of application No. 16/563,937, filed on Sep. 9, 2019, now Pat. No. 10,811,824.

(30) Foreign Application Priority Data

Dec. 27, 2018 (JP) ..... JP2018-244661

(51) Int. Cl.
*H01R 13/6585* (2011.01)
*H01R 12/71* (2011.01)
(Continued)

(52) U.S. Cl.
CPC ..... *H01R 13/6585* (2013.01); *H01R 12/716* (2013.01); *H01R 12/73* (2013.01); *H01R 13/6471* (2013.01); *H01R 13/6597* (2013.01)

(58) Field of Classification Search
CPC ..... H01R 13/6585; H01R 13/6597; H01R 13/6471; H01R 12/716; H01R 12/73
(Continued)

(56) References Cited

U.S. PATENT DOCUMENTS 6,250,935 B1 6/2001 Mochizuki et al.
8,845,339 B2 * 9/2014 Ono ..... H01R 12/7052 439/74
(Continued)

FOREIGN PATENT DOCUMENTS

CN 102088151 A 6/2011
CN 107809018 A 3/2018
(Continued)

OTHER PUBLICATIONS

Office Action received for KR Application No. 10-2021-0026113, dated Mar. 17, 2021, 10 Pages. (5 Pages of English Translation and 5 Pages of Official notification).
(Continued)

*Primary Examiner* — Gary F Paumen

(57) ABSTRACT

The first connector body includes: a recess mating with the second connector body; a first side wall part extending in the longitudinal direction so as to define both sides of the recess; and a projection extending in the longitudinal direction of the recess so as to mate with a recessed groove of the second connector body, the first terminal includes a first contact part contacting the second terminal in a recessed groove between the projection and the first side wall part, the first connector further includes a shield plate which is held in the center in the width direction of the projection so as to extend in the longitudinal direction, the second reinforcing bracket includes a reference potential connection part connected to a reference potential trace; and a tongue part contacting both ends in the longitudinal direction of the shield plate, and the second connector further includes a reference potential terminal which includes a tail part connected to the reference potential trace along with a contact part contacting the middle of the shield plate in the longitudinal direction.

13 Claims, 12 Drawing Sheets

(51) Int. Cl.
*H01R 13/6597* (2011.01)
*H01R 13/6471* (2011.01)
*H01R 12/73* (2011.01)

(58) Field of Classification Search
USPC ..... 439/74
See application file for complete search history.

(56) References Cited

U.S. PATENT DOCUMENTS

| | | | | |
|---|---|---|---|---|
| 9,590,327 | B2 * | 3/2017 | Matsuno | H01R 12/7005 |
| 10,249,969 | B2 * | 4/2019 | Ono | H01R 13/504 |
| 10,651,579 | B2 * | 5/2020 | Ono | H01R 13/631 |
| 10,811,824 | B2 * | 10/2020 | Teruki | H01R 13/6597 |
| 2013/0005192 | A1 | 1/2013 | Lim | |
| 2013/0330943 | A1 * | 12/2013 | Sasaki | H01R 12/716 439/74 |
| 2016/0315430 | A1 * | 10/2016 | Takeuchi | H01R 12/707 |
| 2017/0264048 | A1 * | 9/2017 | Ashibu | H01R 12/716 |
| 2018/0198241 | A1 | 7/2018 | Ooi | |
| 2018/0277972 | A1 * | 9/2018 | Takeuchi | H01R 12/52 |
| 2019/0181572 | A1 * | 6/2019 | Ono | H01R 13/504 |
| 2020/0044374 | A1 * | 2/2020 | Ishida | H01R 12/721 |
| 2020/0106200 | A1 * | 4/2020 | Ishida | H01R 13/20 |
| 2020/0127400 | A1 * | 4/2020 | Sasayama | H01R 13/631 |
| 2020/0358213 | A1 * | 11/2020 | Tanaka | H01R 12/73 |

FOREIGN PATENT DOCUMENTS

| | | | |
|---|---|---|---|
| CN | 105514708 | B | 4/2018 |
| CN | 108258484 | A | 7/2018 |
| JP | 2013041771 | A | 2/2013 |
| JP | 2017033655 | A | 2/2017 |
| JP | 2017-050235 | A | 3/2017 |
| JP | 2018-110087 | A | 7/2018 |
| JP | 2018-116925 | A | 7/2018 |
| JP | 2018190745 | A | 11/2018 |
| KR | 20140125300 | A | 10/2014 |
| KR | 20150075029 | A | 7/2015 |
| KR | 20160126894 | A | 11/2016 |
| KR | 20170106199 | A | 9/2017 |
| KR | 2018-0028367 | A | 3/2018 |
| TW | I583077 | B | 5/2017 |

OTHER PUBLICATIONS

Office action received for KR Application No. 10-2019-0111862 dated Jul. 23, 2020, 9 pages (5 pages of English translation and 4 pages of official copy).

Notice of allowance received for U.S. Appl. No. 16/563,937 dated Jun. 17, 2020, 8 pages.

Notice of Allowance received for KR application No. 10-2019-0111862, dated Dec. 23, 2020, 3 pages (1 page of English translation and 2 pages of Official copy).

Office Action received for CN Application No. 201911376125.3, dated Mar. 3, 2021, 10 Pages. (5 Pages of English Translation and 5 Pages of Official communication).

Office action received for KR application No. 10-2021-0176905, dated Jan. 3, 2022, 15 pages (8 pages of English translation of 7 pages of Official notification).

Decision to grant received for JP application No. 2018-244661, dated Jul. 5, 2022, 5 pages. (2 pages of english translation and 3 pages of official copy).

* cited by examiner

Prior art

CONNECTOR ASSEMBLY

RELATED APPLICATIONS

This application is a continuation of U.S. application Ser. No. 16/563,937, filed on Sep. 9, 2019, which claims priority to Japanese Application No, 2018-244661, filed on Dec. 27, 2018. Each of the foregoing applications are incorporated herein by reference in their entireties.

TECHNICAL FIELD

The present disclosure relates to a connector assembly.

BACKGROUND ART

Conventionally, connectors such as board to board connectors, etc., have been used to electrically connect pairs of parallel circuit boards together. Such connectors are attached to each mutually facing surface on pairs of circuit boards and mated together so as to be connected. Moreover, in order to prevent crosstalk between signal terminals, a technique for providing a shield member between the signal terminals is proposed (for example, see Patent Document 1).

FIG. 12 is a perspective view illustrating a conventional terminal and shield member.

In the figure, 851 is a reinforcing bracket installed on both ends in the longitudinal direction of a housing of a connector mounted on a circuit substrate (not illustrated), and connected to a side wall cover part 852 installed on a side wall part of the housing, wherein this side wall cover part 852 is connected to a connection pad coupled to a ground trace of the circuit substrate by soldering, etc. Moreover, multiple signal terminals 861 are arranged and installed on each side wall part on both the left and right sides of the housing, with each signal terminal 861 connected to the connection pad coupled to a signal trace of the circuit substrate by soldering, etc.

In addition, a shield plate 856 extending in the longitudinal direction of the housing is provided between rows of the signal terminals 861 arranged on both the left and right sides. Each shield plate 856 is connected to the side wall cover part 857 installed on the side wall part of the housing at a position facing the side wall cover part 852 of the reinforcing bracket 851, with this side wall cover part 857 connected to the connection pad coupled to the ground trace of the circuit substrate by soldering, etc. As a result, because the signal terminals 861 on both sides facing each other are shielded by the shield plate 856, even if a high frequency signal is transmitted, crosstalk between the signal terminals 861 can be prevented.

Patent Document: Patent Document 1: JP 2018-110087 A

SUMMARY

Unfortunately, in the conventional connector, because only one end in the longitudinal direction of each shield plate 856 extending in the longitudinal direction of a housing is connected to a ground trace of a circuit substrate via the side wall cover part 857, the vicinity of the other end in the longitudinal direction of each shield plate 856 has a conductive path with a long span to the ground trace, deteriorating the shield effects of the shield plate 856.

Here, in order to solve the problems of the conventional connector, the object is to provide a connector assembly which reduces the span of a conductive path from a shield plate provided between rows of terminals to a reference potential trace, in addition to enhancing the shield effects and reliability.

Therefore, a connector assembly includes: a first connector which includes a first connector body, a first terminal mounted on the first connector body, and a first reinforcing bracket mounted on the first connector body; and a second connector which includes a second connector body, a second terminal mounted on the second connector body, and a second reinforcing bracket mounted on the second connector body, and which mates with the first connector, wherein the first connector body includes: a recess mating with the second connector body; a first side wall part extending in the longitudinal direction so as to define both sides of the recess; and a projection extending in the longitudinal direction of the recess so as to mate with a recessed groove of the second connector body, wherein the first terminal includes a first contact part contacting the second terminal in the recessed groove between the projection and the first side wall part, wherein the first connector further includes a shield plate which is held in the center in the width direction of the projection so as to extend in the longitudinal direction, wherein the second reinforcing bracket includes a reference potential connection part connected to a reference potential trace; and a tongue part contacting both ends in the longitudinal direction of the shield plate, and wherein the second connector further includes a reference potential terminal which includes a tail part connected to the reference potential trace along with a contact part contacting the middle of the shield plate in the longitudinal direction.

Further, in another connector assembly, the second connector body includes a second side wall part extending in the longitudinal direction so as to define both sides of the recessed groove, the reference potential terminal includes a holding part held by the second side wall part along with a connection part extending from this holding part in the width direction, and the contact part is connected to the free end of this connection part.

Further, in another connector assembly, the second terminal is arranged in plural in the longitudinal direction so as to be provided on the second side wall part, while the holding part of the reference potential terminal is disposed between the second terminals arranged in the longitudinal direction.

Further, in yet another connector assembly, the reference potential terminal is disposed at multiple locations in the longitudinal direction.

Further, in yet another connector assembly, the second reinforcing bracket includes: a second body part formed on both ends in the longitudinal direction; and a second side plate part extending in the longitudinal direction, with both ends thereof connected to the second body part, wherein the reference potential connection part is connected to the outer end of the second body part, while the tongue part is connected to the inner end of the second body part.

Further, in yet another connector assembly, the second side plate part is spaced distal from the outer side face of the second side wall part of the second connector body.

Further, in yet another connector assembly, the first reinforcing bracket includes: a first body part formed on both ends in the longitudinal direction; and a first side plate part extending in the longitudinal direction, with both ends thereof connected to the first body part, wherein this first side plate part includes an engagement swollen part which swells to the center in the width direction so as to be engageable with an engagement recess formed in the second side plate part.

According to the present disclosure, the connector assembly can reduce the span of a conductive path from a shield plate provided between rows of terminals to a reference potential trace, thereby obtaining high shield effects and improving reliability.

BRIEF DESCRIPTION OF DRAWINGS

FIGS. 7A-7D are four plane views of the state in which the first connector and the second connector according to Embodiment 1 are mated, wherein FIG. 7A is a plan view as seen from above the first connector, FIG. 7B is the cross sectional view in the arrow direction along line C-C of FIG. 7A, FIG. 7C is the cross sectional view in the arrow direction along line A-A of FIG. 7A, and FIG. 7D is the cross sectional view in the arrow direction along line B-B of FIG. 7A.

DETAILED DESCRIPTION OF THE PREFERRED EMBODIMENTS

An embodiment will be described in detail below with reference to the drawings.

Figure 1:
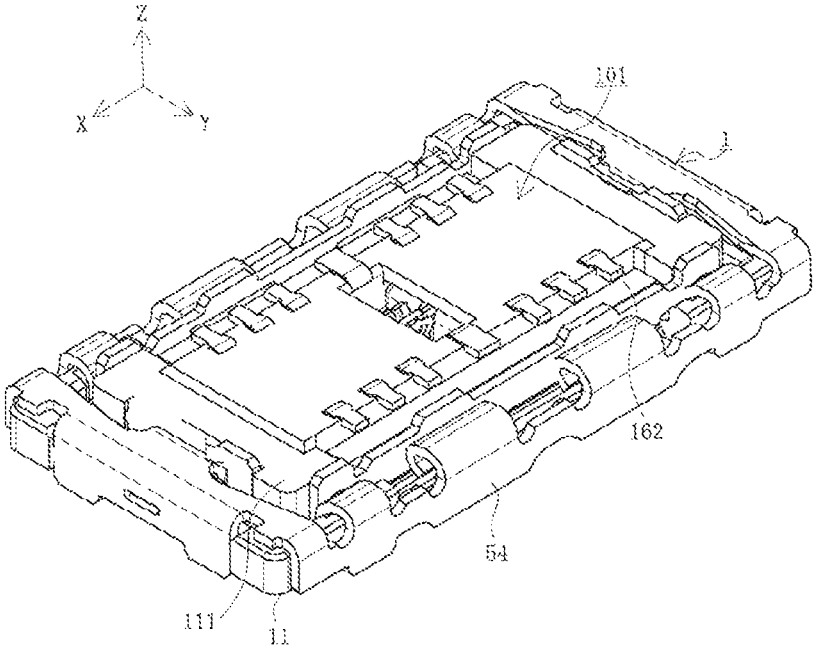
FIG. 1 is a perspective view of the state in which a first connector and a second connector according to Embodiment 1 are mated.
Figure 2:
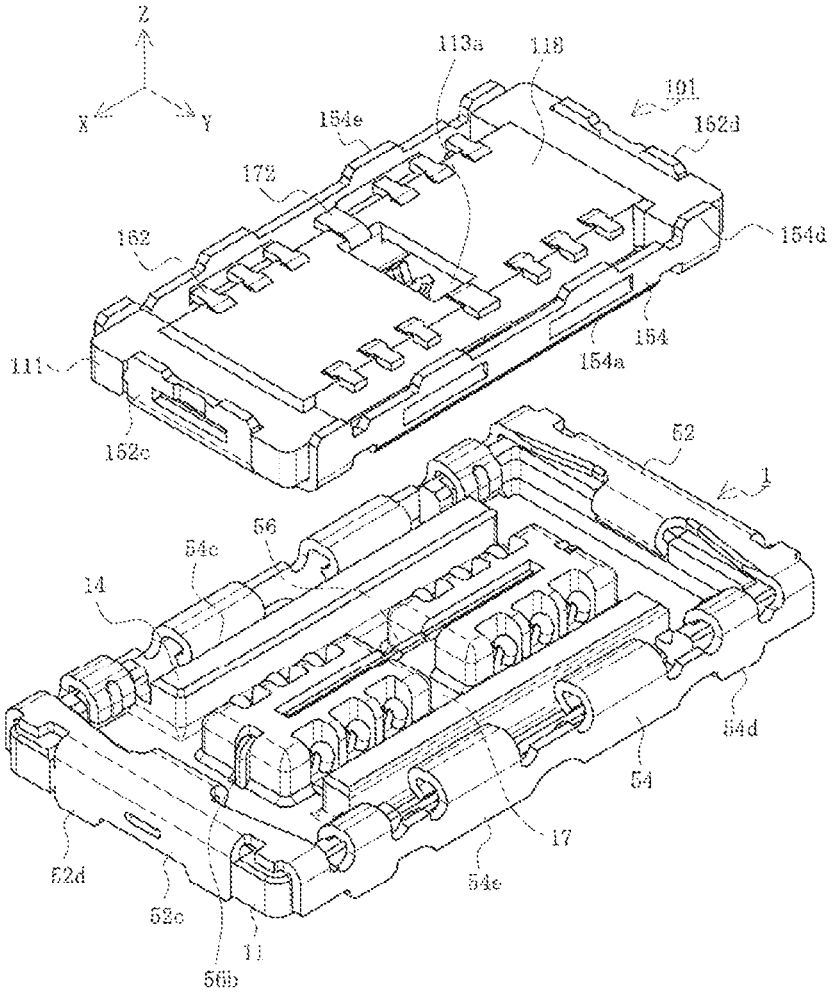
FIG. 2 is a perspective view of the first connector and the second connector according to Embodiment 1.
Figure 3:
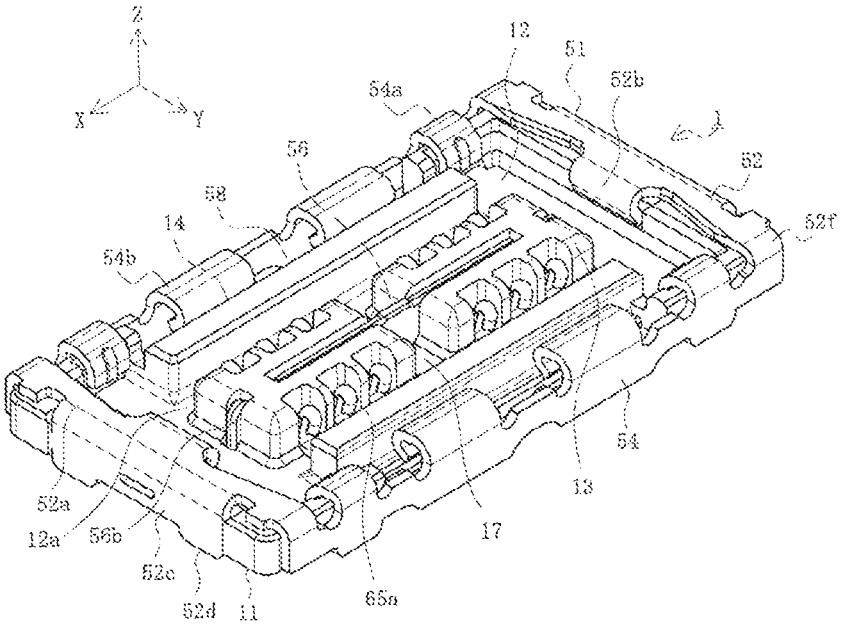
FIG. 3 is a perspective view of the first connector according to Embodiment 1.
Figure 4:
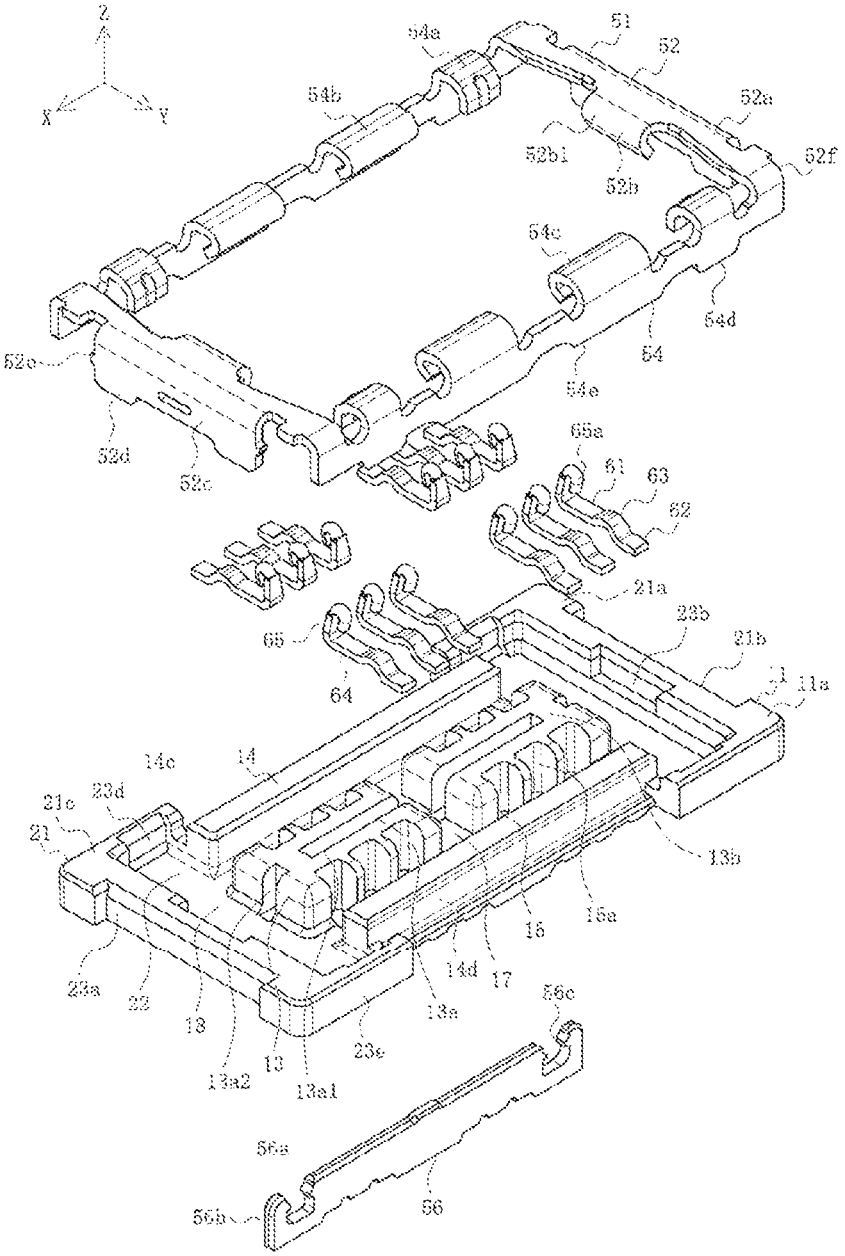
FIG. 4 is an exploded view of the first connector according to Embodiment 1.
Figure 5:
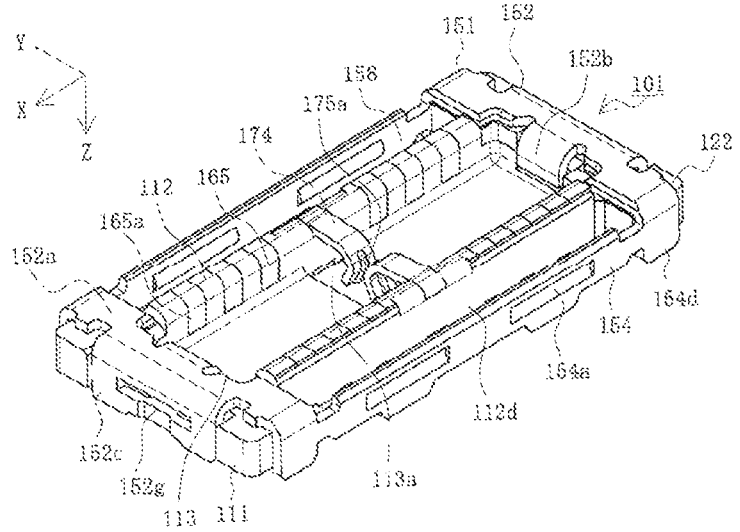
FIG. 5 is a perspective view of the second connector according to Embodiment 1.
Figure 6:
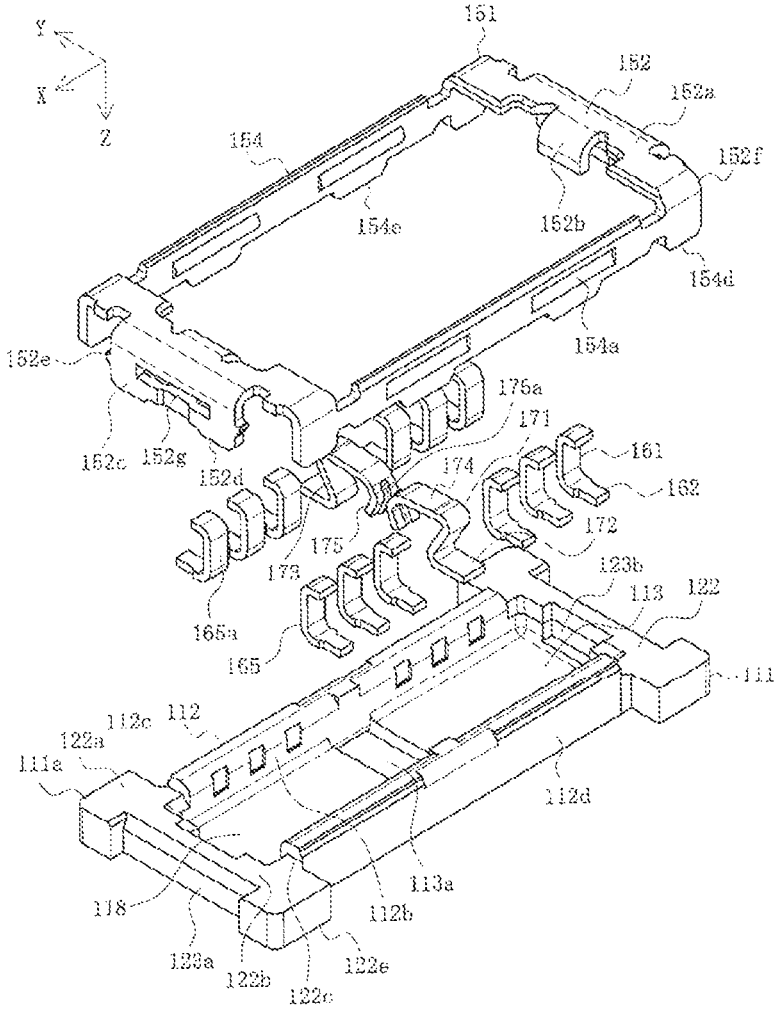
FIG. 6 is an exploded view of the second connector according to Embodiment 1.
Figure 7A:
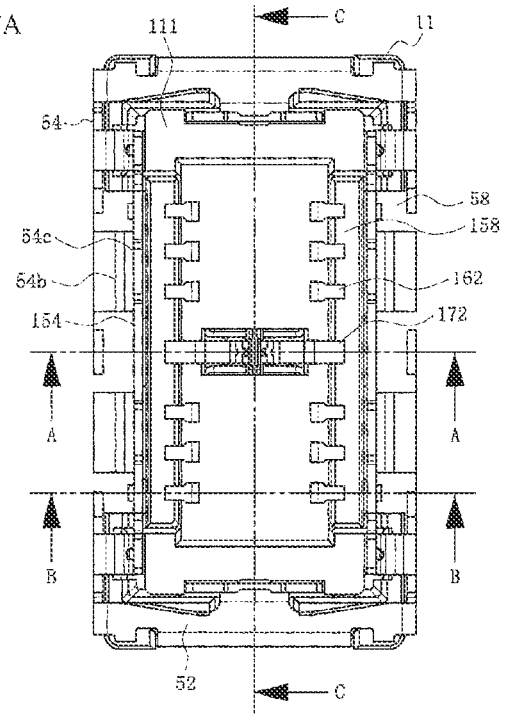
Figure 7B:
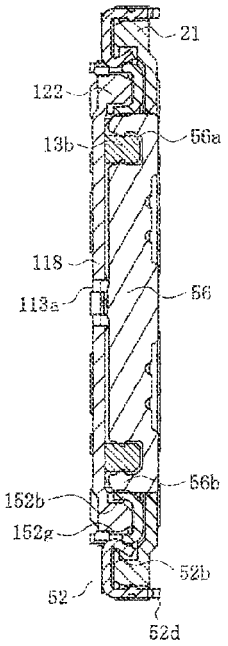
Figure 7C:
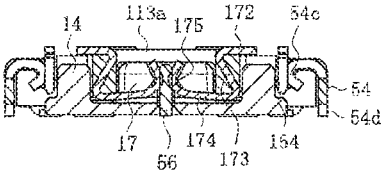
Figure 7D:
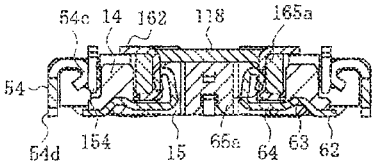

FIG. 1 is a perspective view of the state in which a first connector and a second connector according to Embodiment 1 are mated, FIG. 2 is a perspective view of the first connector and the second connector according to Embodiment 1, FIG. 3 is a perspective view of the first connector according to Embodiment 1, FIG. 4 is an exploded view of the first connector according to Embodiment 1, FIG. 5 is a perspective view of the second connector according to Embodiment 1, FIG. 6 is an exploded view of the second connector according to Embodiment 1, and FIGS. 7A-7D are four plane views of the state in which the first connector and the second connector according to Embodiment 1 are mated. Note that in FIGS. 7A-7D, FIG. 7A is a plan view as seen from above the first connector, FIG. 7B is the cross sectional view in the arrow direction along line C-C of FIG. 7A, FIG. 7C is the cross sectional view in the arrow direction along line A-A of FIG. 7A, and FIG. 7D is the cross sectional view in the arrow direction along line B-B of FIG. 7A.

In the figure, 1 is a connector of the present embodiment and is the first connector serving as one of a pair of board to board connectors serving as a connector assembly. The first connector 1 is a surface mount type connector mounted on the surface of a first substrate (not illustrated) serving as a mounting member and is mated to a second connector 101 that serving as a counterpart connector. Furthermore, the second connector 101 is the other of the pair of board to board connectors and is a surface mount type connector mounted on the surface of a second substrate (not illustrated) serving as a mounting member.

Note that while the first connector 1 and the second connector 101 are ideally used for electrically connecting the first substrate and the second substrate serving as substrates, the connectors can also be used to electrically connect other members. Examples of the first substrate and the second substrate include printed circuit boards, flexible flat cables (FFC), flexible printed circuit boards (FPC), etc. used in electronic equipment, etc., but may be any type of substrate.

Furthermore, expressions indicating directions such as up, down, left, right, front, and back used to describe the operations and configurations of the parts of the first connector 1 and the second connector 101 in the present embodiment are not absolute but rather relative directions, and though appropriate when the parts of the first connector 1 and the second connector 101 are in the positions illustrated in the figures, these directions should be interpreted differently when these positions change in order to correspond to said change.

Furthermore, the first connector 1 has a first housing 11 as a first connector body integrally formed of an insulating material such as synthetic resin. As illustrated in the drawing, the first housing 11 is a substantially rectangular body having a substantially rectangular thick plate shape, wherein a first recess 12 serving as a substantially rectangular recess surrounding the periphery and mating with a second housing 111 as the second connector body of the second connector 101 is formed on the side in which the second connector 101 fits, that is, on the mating face 11*a* side (Z axis positive direction side). In addition, a first projection 13 as a projection mating with a recessed groove 113 of the second connector 101 is integrally formed with the first housing 11 in this first recess 12.

Note that in the present embodiment, the first projection 13 is divided into two in the longitudinal direction by groove shaped splitting groove parts 17 formed so as to extend in the width direction (Y axis direction) of the first housing 11 in the center in the longitudinal direction (X axis direction) of the first housing 11. Moreover, a first side wall part 14, which extends parallel to the first projection 13 on both sides (Y axis positive direction side and negative direction side) of this first projection 13 and defines both sides of the first recess 12, is integrally formed with the first housing 11.

In addition, the first projection 13 and the first side wall part 14 protrude upward from a bottom plate 18 defining the bottom face of the first recess 12 (Z axis positive direction) and extend in the longitudinal direction of the first housing 11. Consequently, a recessed groove 12*a* as an elongated recess which extends in the longitudinal direction of the first housing 11 as a portion of the first recess 12 is formed on both sides of the first projection 13.

Here, first terminal housing cavities 15 are formed from the side faces on both sides of the first projection 13 to the bottom face of the recessed groove 12*a*. In the illustrated example, the first terminal housing cavities 15 are formed so as to penetrate through the bottom plate 18 in the plate thickness direction (Z axis direction). Note that in the first terminal housing cavities 15, recessed groove parts formed on the side faces on both sides of the first projection 13 are referred to as first terminal housing inner cavities 15*a*.

In the present embodiment, a plurality (for example, three) of the first terminal housing cavities 15 are each formed at a predetermined pitch on both sides of each first projection 13 so as to form two rows in the longitudinal direction of the first housing 11. Note that the pitch and number of the first terminal hosing cavities 15 can be appropriately changed. In addition, a plurality of first terminals 61 as terminals which are housed in each of the first terminal housing cavities 15 and installed on the first housing 11 are disposed on both sides of each first projection 13 at the same pitch.

Each of the first terminals 61 is a member integrally formed by carrying out processing such as punching and bending on the conductive metal plate and includes: a first holding part 63 serving as a holding part held by the first housing 11; a first tail part 62 serving as a tail part connected to one end of this first holding part 63; a first connecting part 64 connected to the other end of the first holding part 63; a first contact arm 65 connected to the tip of this first connecting part 64; and a first contact part 65*a* serving as a contact part formed at the tip of this first contact arm 65, that is, a free end.

In addition, the first terminal 61 is integrated with the first housing 11 by overmolding or insert molding. That is, the first housing 11 is molded by filling the cavity of a mold, in which the first terminal 61 has been set beforehand, with an insulating material such as synthetic resin. Consequently, the first terminal 61 is integrally attached to the first housing 11, with at least the first holding part 63 embedded in the first housing 11. Note that the first terminal 61 is not necessarily integrated with the first housing 11 by overmolding or insert molding and may be attached to the first housing 11 by press fitting, etc., wherein, for convenience of description, the case of integration with the first housing 11 by overmolding or insert molding will be described.

The first holding part 63 is a member which generally extends in the left and right direction (Y axis direction), that is, in the width direction of the first housing 11, but is bent so as to expand upward (in the Z axis positive direction), allowing it to be embedded and held in the first side wall part 14. Moreover, the first tail part 62 stretches in the left and right direction from one end of the first holding part 63, more specifically, stretches outwardly in the width direction of the first housing 11, and is connected to a connection pad coupled to a conductive trace of the first substrate by soldering, etc. Note that the conductive trace is typically a signal line. Further, the first connecting part 64 stretches in the left and right direction from one end of the first holding part 63, more specifically, stretches inwardly in the width direction of the first housing 11. Further, the first contact arm 65 stretches upward from the tip of the first connecting part 64, with the first contact part 65*a* formed in the vicinity of the upper end thereof and bent at 180° so as to form a U shape and expand outwardly in the width direction of the first housing 11.

The first terminal 61 is fixed to the first housing 11, with at least most of the first holding part 63 embedded in the first side wall part 14 and with at least most of the first connecting part 64 and the first contact arm 65 housed in the first terminal housing cavities 15. In this state, that is, with the first terminal 61 installed in the first housing 11, the first contact part 65*a* is directed outwardly in the width direction of the first housing 11 so as to be exposed on the side face facing the first side wall part 14 in the first projection 13. Specifically, at least a portion of the first contact part 65*a* protrudes from the first terminal housing inner cavities 15*a* into the recessed groove 12*a*.

Note that the first terminal 61 is a member which is integrally formed by processing a metal plate and therefore has a certain degree of elasticity. In addition, as is clear from the shape, the first connecting part 64, the first contact arm 65, and the first contact part 65*a* can be elastically deformed. Accordingly, if a second side wall part 112 of the second connector 101 with a second terminal 161 attached thereto is inserted into the recessed groove 12*a*, the first contact part 65*a* contacting the second terminal 161 is elastically displaced inwardly in the width direction of the first housing 11.

Moreover, a shield plate housing slit 13*a* which is a slit shaped groove extending in the longitudinal direction (X axis direction) and the vertical direction (Z axis direction) is formed in the center in the width direction (Y axis direction) of the first projection 13. This shield plate housing slit 13*a* opens on the lower face of a bottom plate 18, in addition to opening on the upper face of each first projection 13 and the end face in the longitudinal direction thereof. Note that each shield plate housing slit 13*a* is divided into two in the longitudinal direction by a slit dividing part 13*b* so as to consist of a main part 13*a*1 and a sub part 13*a*2 shorter than this main part 13*a*1. This sub part 13*a*2 is a part disposed on both ends in the longitudinal direction of the first housing 11 compared with the main part 13*a*1.

In addition, a shield plate 56 which is an elongated belt shaped plate member extending in the thickness direction (Z axis direction) and the longitudinal direction of the first housing 11 formed by the processing (such as punching) of a conductive metal plate is housed and held in the shield plate housing slit 13*a*. A mating recess 56*a* which is recessed downward (towards the Z axis negative direction) from the upper end is formed in the vicinity of both ends in the longitudinal direction of this shield plate 56, while an engagement projection 56*c* is formed on the inner face of this mating recess 56*a*. In addition, once the shield plate 56 is inserted or press fitted in the shield plate housing slit 13*a* from the lower face side of the bottom plate 18, the slit dividing part 13*b* is relatively advanced in the mating recess 56*a*, while the engagement projection 56*c* bites and engages with the side face of the slit dividing part 13*b*. As a result, the shield plate 56 is housed and held in the shield plate housing slit 13*a*. Therefore, the shield plate 56 is disposed between two rows of the first terminals 61 arrayed along the left and right recessed grooves 12*a*, effectively preventing crosstalk between two rows of the first terminals 61.

With the shield plate 56 housed in the shield plate housing slit 13*a*, an end edge 56*b* on both ends in the longitudinal direction of the shield plate 56 is exposed outward from the sub part 13*a*2. Moreover, the central part in the longitudinal direction of the shield plate 56 is exposed in the splitting groove parts 17. Note that the shield plate 56 is not necessarily installed in the first housing 11 by insertion or press fitting and, as in the first terminals 61, may be integrated with the first housing 11 by overmolding or insert molding. However, for convenience of description, the case in which the shield plate 56 is installed in the first housing 11 by insertion or press fitting so as to be housed in the shield plate housing slit 13*a* will be described.

Moreover, each first protruding end part 21 as a mating guide part is disposed on both ends in the longitudinal direction of first housing 11. A mating recess 22 as a portion of the first recess 12 is formed on each first protruding end part 21. The mating recess 22 is a substantially rectangular recess connected to both ends in the longitudinal direction of each recessed groove 12*a*. Additionally, in the state in which the first connector 1 and the second connector 101 are mated, a second protruding end part 122 contained in second connector 101 is inserted into the mating recess 22.

Further, the first protruding end part 21 includes: a first side wall extension 21*c* as a mating guide side wall part which stretches in the longitudinal direction of the first housing 11 from both ends in the longitudinal direction of the first side wall part 14; and a first end wall 21*b* which extends in the width direction of the first housing 11 with both ends thereof connected to the first side wall extension 21*c*. In each first protruding end part 21, the first end wall 21*b* and the first side wall extension 21*c* connected to both ends thereof form a continuous substantially U-shaped side wall and define three sides of a substantially rectangular mating recess 22. In addition, in the first end wall 21*b*, an outer end recess 23*a* as a recessed first central foot housing part is formed on the outer side face, while a recessed inner end recess 23*b* is formed on the inner side face. Moreover, in the first side wall extension 21*c*, an inner side recess 23*d* as a recessed inner plate housing part is formed on the inner side face.

In addition, a first reinforcing bracket 51 as a reinforcing bracket installed thereto is attached to the first housing 11. In the present embodiment, a first reinforcing bracket 51, as a member integrally formed by carrying out processing such as punching and bending on the metal plate, is positioned on both ends in the longitudinal direction (X axis direction) of the first housing 11, and includes: first body parts 52 serving as a pair of body parts covering the outside of the first end wall 21*b* of the first protruding end part 21; and a first side plate part 54 as a first coupling part serving as a pair of coupling parts which extend in the longitudinal direction of the first housing 11 and couple the first body parts 52.

The first body part 52 includes: a first body upper face part 52*a* which extends in the width direction of the first housing 11 and covers the majority of the upper face 21*a* of the first end wall 21*b*; an end wall inner cover part 52*b* as a tongue part which stretches downward from the inner end edge of the first end wall 21*b* in this first body upper face part 52*a*; an engagement swollen part 52*b*1 formed in the end wall inner cover part 52*b* so as to swell towards the center in the longitudinal direction of the first housing 11; an end wall outer cover part 52*c* as a first central foot which stretches downward from the outer end edge of the first end wall 21*b* in the first body upper face part 52*a*; a first central connection foot 52*d* which stretches downward from the lower end of this end wall outer cover part 52*c*; and an engagement projection 52*e* formed at the side end of the end wall outer cover part 52*c*.

In addition, with the first reinforcing bracket 51 attached to the first housing 11, the first body upper face part 52*a* covers the majority of the upper face 21*a* of the first end wall 21*b*, at least a portion of the end wall inner cover part 52*b* is housed in the inner end recess 23*b*, the engagement swollen part 52*b*1 protrudes from the inner end edge of the first end wall 21*b* towards the center in the longitudinal direction of the first housing 11, most of the end wall outer cover part 52*c* is housed in the outer end recess 23*a*, and the engagement projection 52*e* engages with the side wall of the outer end recess 23*a* so as to be fixed into the outer end recess 23*a*. Note that the first central connection foot 52*d* functions as a reference potential connection part, with the lower end thereof protruding downward so as to be connected to a connection pad coupled to a reference potential trace such as a power trace or ground trace of a first substrate by soldering, etc. Consequently, the first reinforcing bracket 51 tends not to be deformed, with the first connector 1 effectively reinforced.

The first side plate part 54 is an elongated flat belt shaped plate which extends in the thickness direction (Z axis direction) and the longitudinal direction of the first housing 11, with both ends in the longitudinal direction thereof connected to both ends of the first body upper face part 52*a* via a curved connection part 52*f*. In addition, a pair of double end side contact parts 54*a* are each connected in the vicinity of both ends in the longitudinal direction of each first side plate part 54, while a pair of central contact parts 54*b* are each connected at a part closer to the center on both ends in the longitudinal direction. As seen in the longitudinal direction (X axis direction) of the first housing 11, each double end side contact part 54*a* is a member curved in a substantially U shape, wherein one end thereof is connected to the upper end of the first side plate part 54, the curved part swells upward, and the other end as a free end stretches downward (in the Z axis negative direction). Moreover, as seen in the longitudinal direction of the first housing 11, each central contact part 54*b* is a member curved in a substantially C shape, wherein one end thereof is connected to the upper end of the first side plate part 54, a first curved part swells upward, a second curved part is an engagement swollen part 54*c* which swells towards the center in the width direction (Y axis direction) of the first housing 11, and the other end as a free end stretches diagonally downward. Moreover, a double end side connection foot 54*d* stretches downward from a position corresponding to the double end side contact part 54*a* at the lower end of each first side plate part 54, a central connection foot 54*e* stretches downward from a position corresponding to the central contact part 54*b*.

In addition, with the first reinforcing bracket 51 installed in the first housing 11, the double end side contact part 54*a* is housed in the inner side recess 23*d* of the first side wall extension 21*c*. Moreover, the first side plate part 54 covers the outside in the width direction of the first housing 11 in the first protruding end part 21 and the first side wall part 14. However, because a side wall recess 14*c* recessed thereinside is formed outside in the width direction of the first housing 11 in the first side wall part 14, the first side wall part 14 is disposed more internally in the width direction of the first housing 11 than the first side wall extension 21*c* as a whole, while the outer side face 14*d* of the first side wall part 14 is disposed more internally in the width direction of the first housing 11 than the outer side face 23*e* of the first side wall extension 21*c*. Therefore, the first side plate part 54 covering the outer side face 23*e* of the first side wall extension 21*c* is spaced distal from the outer side face 14*d* of the first side wall part 14, with a first side gap 58 formed between the first side plate part 54 and the outer side face 14*d* of the first side wall part 14. In addition, the engagement swollen part 54*c* of the central contact part 54*b* protrudes towards the outer side face 14*d* of the first side wall part 14 in the first side gap 58. Moreover, the first tail part 62 of the first terminal 61 protrudes outwardly from the outer side face 14*d* of the first side wall part 14 in the width direction of the first housing 11 and is positioned within the first side gap 58 inside the first side plate part 54. Accordingly, the overall first terminal 61 is positioned inside the first side plate part 54 in the width direction of the first housing 11 so as to be isolated from the outside, improving the shielding properties of the first connector 1.

Further, the double end side connection foot 54*d* and the central connection foot 54*e* function as a reference potential connection part, with the lower end thereof protruding downward so as to be connected to a connection pad coupled to a reference potential trace such as a power trace or ground trace of a first substrate by soldering, etc. Consequently, the first reinforcing bracket 51 tends not to be deformed, with the first connector 1 effectively reinforced, improving the shielding properties thereof.

Next, the configuration of the second connector 101 will be described.

The second connector 101 as a counterpart connector according to the present embodiment has the second housing 111 as a counterpart connector body integrally formed of an insulating material such as synthetic resin. As illustrated in the figure, this second housing 111 is a substantially rectangular body with the shape of a substantially rectangular thick plate. In addition, on the side of the second housing 111 which fits in the first connector 1, that is, the mating surface 111*a* side (Z axis negative direction side), an elongated recessed groove 113 which extends in the longitudinal direction (X axis direction) of the second housing 111 is integrally formed with a second side wall part 112 serving as an elongated projection which defines the outside of this recessed groove 113 and extends in the longitudinal direction of the second housing 111. This second side wall part 112 is formed along both sides of the recessed groove 113 and along both sides of the second housing 111. Additionally, a second terminal 161 as a counterpart terminal is disposed in each second side wall part 112. The second terminal 161 is disposed at the pitch corresponding to the first terminal 61 and in the number corresponding thereto. The recessed groove 113 is closed by a bottom plate 118 on the side mounted on a second substrate, that is, the mounting surface side (Z axis positive direction side).

The second terminal 161 is a member integrally formed by carrying out processing such as punching and bending on the conductive metal plate and includes a second connecting part 165 as well as a second tail part 162 connected to this second connecting part 165. In addition, the second terminal 161 is integrated with the second housing 111 by overmolding or insert molding That is, the second housing 111 is molded by filling the cavity of a mold, in which the second terminal 161 has been set beforehand, with an insulating material such as synthetic resin. As a result, at least a portion of the second terminal 161 is embedded in the second housing 111 so as to be integrally attached to the second housing 111. Note that the second terminal 161 is not necessarily integrated with the second housing 111 by overmolding or insert molding and may be attached to the second housing 111 by press fitting, etc., wherein, for convenience of description, the case of the integration with the second housing 111 by overmolding or insert molding will be described.

The second connecting part 165 is a member having a substantially U shape when viewed from the side, wherein the part extending in the left and right direction (Y axis direction) is connected to both the up and down ends of the part which extends in the up and down direction (Z axis direction), and wherein at least a portion of the inward surface in the width direction of the second housing 111 in the part extending in the up and down direction is exposed on the inner side face 112*b* of the second side wall part 112 so as to function as a second contact part 165*a* serving as a counterpart contact part. This second contact part 165*a* is substantially flush with the inner side face 112*b* of the second side wall part 112. Moreover, the second tail part 162 stretches in the left and right direction from the tip of the part which extends in the left and right direction on the lower side of the second connecting part 165, more specifically, stretches outwardly in the width direction of the second housing 111, and is connected to a connection pad coupled to a conductive trace of the second substrate by soldering, etc. Note that the conductive trace is typically a signal line.

Further, a ground terminal 171 as a reference potential terminal is provided in each second side wall part 112. This ground terminal 171 is a terminal which contacts the shield plate 56 of the first connector 1 and is provided at a position corresponding to the splitting groove parts 17 with the central part in the longitudinal direction of the shield plate 56 exposed. Note that an opening 113*a* may be formed at a position corresponding to the ground terminal 171 in the bottom plate 118 of the second housing 111 as required.

The ground terminal 171 is a member integrally formed by carrying out processing such as punching and bending on the conductive metal plate and includes: a ground holding part 173 serving as a holding part held by the second housing 111; ground tail part 172 serving as a tail part connected to the lower end (end in the Z axis positive direction) of this ground holding part 173; a ground connection part 174 serving as a connection part connected to the upper end (end in the Z axis negative direction) of the ground holding part 173; and a ground contact arm part 175 connected to the tip of this ground connection part 174. In addition, as in the second terminal 161, the ground terminal 171 is integrated with the second housing 111 by overmolding or insert molding. As a result, at least a portion of the ground terminal 171 is embedded in the second housing 111 so as to be integrally attached to the second housing 111. Note that as in the second terminal 161, the ground terminal 171 is not necessarily integrated with the second housing 111 by overmolding or insert molding and may be attached to the second housing 111 by press fitting, etc., wherein, for convenience of description, the case of the integration with the second housing 111 by overmolding or insert molding will be described.

Moreover, in the present embodiment, the width of the ground terminal 171 is set to be appropriately two-fold the width of the second terminal 161, but may be set to the width from the same degree to approximately three-fold.

The ground holding part 173 is a member which is tilted in the left and right direction (Y axis direction) so as to extend in the vertical direction, allowing it to be embedded and held in the second side wall part 112. Moreover, the ground tail part 172 stretches in the left and right direction from the lower end of the ground holding part 173, more specifically, stretches outwardly in the width direction of the second housing 111, and is connected to a connection pad coupled to a reference potential trace such as a power trace or ground trace of a second substrate by soldering, etc. Further, the ground connecting part 174 stretches in the left and right direction from the upper end of the ground holding part 173, more specifically, stretches inwardly in the width direction of the second housing 111. Further, the ground contact arm part 175 is formed so as to swell inwardly in the width direction of the second housing 111 from the tip as a free end of the ground connection part 174, with the swollen end functioning as a ground contact part 175*a* serving as a contact part with the shield plate 56.

The ground terminal 171 is fixed to the second housing 111, with at least the majority of the ground holding part 173 embedded in the second side wall part 112 and with at least the majority of the ground connection part 174 and the ground contact arm part 175 exposed and housed in the recessed groove 113. In this state, that is, the state in which the ground terminal 171 is installed in the second housing 111, the ground contact parts 175*a* of a pair of ground terminals 171 face each other and approach or abut each other with the interval therebetween smaller than the thickness of the shield plate 56.

Moreover, as illustrated in FIG. 7C, the part embedded in the second side wall part 112 in the ground terminal 171 has a substantially Z shape in a cross sectional view. Such a shape allows the ground terminal 171 to use the long distance between the ground connection part 174 and the ground holding part 173 from the ground contact part 175*a* as the spring length. As a result, the ground terminal 171 has a suitable contact pressure with a long spring length used for the shield plate 56. Moreover, the ground terminal 171 is held to the second side wall part 112 by the upper face of the ground connection part 174, both faces of the ground holding part 173, and the lower face of the ground tail part 172. When the second side wall part 112 is held by many sides in this manner, the ground terminal 171 is firmly held to the second housing 111. Furthermore, the ground tail part 172 stretches outwardly from the second connector 101 from the range approaching the inner side face of the second side wall part 112 and therefore faces the second substrate, such that the location connected to the second substrate by soldering, etc. can be set to be long. Therefore, the ground terminal 171 is firmly held to the second substrate.

Note that the ground terminal 171 is a member which is integrally formed by processing a metal plate and therefore has a certain degree of elasticity. In addition, as is clear from the shape, the ground connection part 174, the ground contact arm part 175, and the ground contact part 175*a* are elastically deformable. Therefore, when the first connector 1 mates with the second connector 101 and the shield plate 56 is inserted between the mutually facing ground contact parts 175*a*, the ground contact parts 175*a* contacting the shield plate 56 are elastically displaced outwardly in the width direction of the second housing 111.

Moreover, each second protruding end part 122 as a counterpart mating guide part is disposed on both ends in the longitudinal direction of the second housing 111. This second protruding end part 122 is a thick member extending in the width direction (Y axis direction) of the second housing 111, with both ends thereof connected to both ends in the longitudinal direction of each second side wall part 112. Additionally, in the state in which the first connector 1 and the second connector 101 are mated, the second protruding end part 122 functions as an insertion protrusion inserted into the mating recess 22 of the first protruding end part 21 contained in the first connector 1.

Further, the second protruding end part 122 includes: a second side wall extension 122*c* as a side wall part of the second protruding end part 122 which stretches in the longitudinal direction of the second housing 111 from both ends in the longitudinal direction of the second side wall part 112; and a second end wall 122*b* which extends in the width direction of the second housing 111 with both ends thereof connected to the second side wall extension 122*c*. In each second protruding end part 122, the second end wall 122*b* and the second side wall extension 122*c* connected to both ends thereof form a continuous substantially U-shaped side wall and define three sides in the vicinity of both ends of a substantially rectangular recessed groove 113. In addition, in the second end wall 122*b*, an outer end recess 123*a* as a recessed second central foot housing part is formed on the outer side face, while a recessed inner end recess 123*b* is formed on the inner side face.

In addition, a second reinforcing bracket 151 as a counterpart reinforcing bracket installed thereto is attached to the second housing 111. In the present embodiment, a second reinforcing bracket 151, as a member integrally formed by carrying out processing such as punching and bending on the metal plate, is positioned at both ends in the longitudinal direction (X axis direction) of the second housing 111, and includes: a pair of second body parts 152 covering the outside of the second end wall 122*b* of the second protruding end part 122; and a second side plate part 154 serving as a pair of counterpart coupling parts which extend in the longitudinal direction of the second housing 111 and couple the second body parts 152.

The second body part 152 includes: a second body upper face part 152*a* which extends in the width direction of the second housing 111 and covers the majority of the upper face 122*a* of the second end wall 122*b*; an end wall inner cover part 152*b* as a tongue part which stretches downward from the inner end edge of the second end wall 122*b* in the second body upper face part 152*a*; an end wall outer cover part 152*c* as a second central foot which stretches downward from the outer end edge of the second end wall 122*b*; a second central connection foot 152*d* as a reference potential connection part which stretches downward from the lower end of this end wall outer cover part 152*c*; an engagement projection 152*e* formed at the side end of the end wall outer cover part 152*c*; and an engagement recess 152*g* formed in the vicinity of the center of the end wall outer cover part 152*c*.

In addition, with the second reinforcing bracket 151 attached to the second housing 111, the second body upper face part 152*a* covers the majority of the upper face 122*a* of the second end wall 122*b*, at least a portion of the end wall inner cover part 152*b* is housed in the inner end recess 123*b*, most of the end wall outer cover part 152*c* is housed in the outer end recess 123*a*, and the engagement projection 152*e* engages with the side wall of the outer end recess 123*a* so as to be fixed into the outer end recess 123*a*. Note that the second central connection foot 152*d* functions as a reference potential connection part, with the lower end thereof protruding downward so as to be connected to a connection pad coupled to a reference potential trace such as a power trace or ground trace of a second substrate by soldering, etc. Consequently, the second reinforcing bracket 151 tends not to be deformed, with the second connector 101 effectively reinforced.

The second side plate part 154 is an elongated flat belt shaped plate which extends in the thickness direction (Z axis direction) and the longitudinal direction of the second housing 111, with both ends in the longitudinal direction thereof connected to both ends of the second body upper face part 152*a* via a curved connection part 152*f*. In addition, an engagement recess 154*a* is formed at a position corresponding to the central contact part 54*b* of the first reinforcing bracket 51 on the outer side face of the second side plate part 154 so as to be recessed. This engagement recess 154*a* is a part which engages with the engagement swollen part 54*c* of the central contact part 54*b* when the first connector 1 mates with the second connector 101. Moreover, a double end side connection foot 154*d* stretches downward from a position corresponding to a part connected to the curved connection part 152*f* at the lower end of the second side plate part 154, while a central connection foot 154*e* stretches downward from a position corresponding to the engagement recess 154*a*.

In addition, when the second reinforcing bracket 151 is installed in the second housing 111, the second side plate part 154 covers the outside in the width direction of the second housing 111 in the second protruding end part 122 and the second side wall part 112. However, because a side wall recess 112*c* recessed thereinside is formed outside in the width direction of the second housing 111 in the second side wall part 112, the outer side face 112*d* of the second side wall part 112 is positioned more internally in the width direction of the second housing 111 than the outer side face 122*e* of the outer side recess 122*c* of the second side wall extension 122*c*. Therefore, the second side plate part 154 covering the outer side face 122*e* of the second side wall extension 122*c* is spaced distal from the outer side face 112*d* of the second side wall part 112, with a second side gap 158 formed between the second side plate part 154 and the outer side face 112*d* of the second side wall part 112. Therefore, because the interval between the second side plate part 154 functioning as a shield and the second terminal 161 can be maintained in this manner, the second side plate part 154 and the second terminal 161 can be prevented from interfering with each other and operating as an antenna.

Further, the double end side connection foot 154*d* and the central connection foot 154*e* function as a reference potential connection part, with the lower end thereof protruding downward so as to be connected to a connection pad coupled to a reference potential trace such as a power trace or ground trace of a second substrate by soldering, etc. Consequently, the second reinforcing bracket 151 tends not to be deformed, with the second connector 101 effectively reinforced, improving the shielding properties thereof.

The operation for mating the first connector 1 and the second connector 101 having the abovementioned configuration will be described next.

Here, the first connector 1 is mounted on the surface of the first substrate by connecting a first tail part 62 of a first terminal 61 to the connection pad coupled to a conductive trace of a first substrate (not illustrated) by soldering, etc., and connecting the lower end of a first central connection foot 52*d* of the first reinforcing bracket 51, the lower end of a double end side connection foot 54*d*, and the lower end of a central connection foot 54*e* to the connection pad coupled to the conductive trace of the first substrate by soldering, etc. Note that the conductive trace coupled to the connection pad with the first tail part 62 of the first terminal 61 connected thereto is a signal line, while the conductive trace coupled to the connection pad with the lower end of the first central connection foot 52*d* of the first reinforcing bracket 51, the lower end of the double end side connection foot 54*d*, and the lower end of the central connection foot 54*e* connected thereto is a reference potential trace such as a power trace or ground trace.

Similarly, the second connector 101 is mounted on the surface of the second substrate by connecting a second tail part 162 of a second terminal 161 to the connection pad coupled to a conductive trace of a second substrate (not illustrated) by soldering, etc., and connecting the ground tail part 172 of the ground terminal 171, the lower end of a second central connection foot 152*d* of the second reinforcing bracket 151, the lower end of a double end side connection foot 154*d*, and the lower end of a central connection foot 154*e* to the connection pad coupled to the conductive trace of the second substrate by soldering, etc. Note that the conductive trace coupled to the connection pad with the second tail part 162 of the second terminal 161 connected thereto is a signal line, while the conductive trace coupled to the connection pad with the ground tail part 172 of the ground terminal 171, the lower end of the double end side connection foot 154*d* of the second reinforcing bracket 151, and the lower end of the central connection foot 154*e* connected thereto is a reference potential trace such as a power trace or ground trace.

First, when an operator makes a mating surface 11*a* of the first housing 11 of the first connector 1 face the mating surface 111*a* of the second housing 111 of the second connector 101, as illustrated in FIG. 2, the position of the second side wall part 112 of the second connector 101 coincides with the position of the corresponding recessed groove 12*a* of the first connector 1, while the position of the second protruding end part 122 of the second connector 101 coincides with the position of the corresponding mating recess 22 of the first connector 1, thereby completing the alignment between the first connector 1 and the second connector 101.

In this state, if the first connector 1 and/or the second connector 101 are moved in the direction approaching the counterpart side, that is, the mating direction (Z axis direction), the second side wall part 112 and the second protruding end part 122 of the second connector 101 are inserted into the recessed groove 12*a* and the mating recess 22 of the first connector 1. Thus, as illustrated in FIGS. 1 and 7A-7D, the first terminal 61 and the second terminal 161 achieve a conduction state upon completion of the mating between the first connector 1 and the second connector 101.

Specifically, a first contact part 65*a* of each first terminal 61 contacts the second contact part 165*a* of the second terminal 161, resulting in the conductive trace coupled to the connection pad on the first substrate with the first tail part 62 of the first terminal 61 connected thereto being conducted with the conductive trace coupled to the connection pad on the second substrate with the second tail part 162 of the second terminal 161 connected thereto. Consequently, the first terminal 61 and the second terminal 161 which correspond to each other come into contact only at a single location, that is, they enter a state of a single contact point compared with contact at multiple locations, that is, a state of multiple contact points, resulting in no unintentional stub or divided circuit being formed in a signal transmission line from the first tail part 62 of the first terminal 61 to the second tail part 162 of the second terminal 161, thereby stabilizing the impedance of the transmission line. Accordingly, also in the case of using the transmission line for transmitting high frequency signals, good SI (signal to interference) characteristics can be obtained.

Moreover, the second protruding end part 122 is inserted into the mating recess 22, the engagement swollen part 52*b*1 of the end wall inner cover part 52*b* of the first reinforcing bracket 51 engages with and contacts the engagement recess 152*g* of the end wall outer cover part 152*c* of the second reinforcing bracket 151, the double end side contact part 54*a* of the first reinforcing bracket 51 contacts the vicinity of both ends in the longitudinal direction of the second side plate part 154 of the second reinforcing bracket 151, and the engagement swollen part 54*c* of the central contact part 54*b* of the first reinforcing bracket 51 engages with and contacts the engagement recess 154*a* of the second side plate part 154 of the second reinforcing bracket 151. Further, the shield plate 56 exposed in the splitting groove parts 17 of the first projection 13 is advanced and contacted between the ground contact parts 175*a* of a pair of left and right ground terminals 171, while the end edge 56*b* of the shield plate 56 exposed on both ends in the longitudinal direction of the first projection 13 contacts an end wall inner cover part 152*b* of the second reinforcing bracket 151. Consequently, the conductive trace coupled to the connection pad on the first substrate (which is connected to the lower end of the first central connection foot 52*d* of the first reinforcing bracket 51, the lower end of the double end side connection foot 54*d*, and the lower end of the central connection foot 54*e*) is conducted with the conductive trace coupled to the connection pad on the second substrate (which is connected to the lower end of the second central connection 152*d* of the second reinforcing bracket 151, the lower end of the double end side connection foot 154*d*, the lower end of the central connection foot 154*e*, and the ground tail part 172 of each ground terminal 171). Therefore, the reference potential trace of the first substrate, the reference potential trace of the second substrate, the first reinforcing bracket 51, the second reinforcing bracket 151, and the shield plate 56 are equipotential, improving the shielding properties.

Further, because the engagement swollen part 52*b*1 of the end wall inner cover part 52*b* of the first reinforcing bracket 51 engages with the engagement recess 152*g* of the end wall outer cover part 152*c* of the second reinforcing bracket 151, the engagement swollen part 54*c* of the central contact part 54*b* of the first reinforcing bracket 51 engages with the engagement recess 154*a* of the second side plate part 154 of the second reinforcing bracket 151, thereby locking the first reinforcing bracket 51 and the second reinforcing bracket 151 and preventing the mating state between the first connector 1 and the second connector 101 from being released.

Because the shield plate 56 connected to the reference potential trace is thus provided between rows of the first contact parts 65*a* of the first terminals 61 contacting the second contact parts 165*a* of the second terminal 161 in the left and right recessed grooves 12*a* of the first connector 1, crosstalk between the first terminals 61 and the second terminals 161 in the left recessed groove 12*a* and the first terminals 61 and the second terminals 161 in the right recessed groove 12*a* can be assuredly prevented.

Moreover, because the end edge 56*b* on both ends in the longitudinal direction of the shield plate 56 contacts the end wall inner cover part 152*b* of the second reinforcing bracket 151 and also because the middle (center in the illustrated example) in the longitudinal direction thereof contacts the ground terminal 171, the conductive path from each part of the shield plate 56 to the reference potential trace is short, improving the shielding properties of each part of the shield plate 56. Because the ground terminal 171 is a member extending in the width direction (Y axis direction) so as to be installed in the second housing 111 narrower than the first housing 11, the conductive path from the ground contact part 175*a* to the ground tail part 172 is short, allowing the conductive path from each part of the shield plate 56 to the reference potential trace to be very short.

Further, also regarding the first side plate part 54 and the second side plate part 154 which also function as a shield, the lower end of the double end side connection foot 54*d* and the lower end of the double end side connection foot 154*d*, which are disposed in the vicinity of both ends in the longitudinal direction thereof, are not only connected to the connection pad, but also the lower end of the central connection foot 54*e* and the lower end of the central connection foot 154*e*, which are disposed closer to the center in the longitudinal direction thereof, are connected to the connection pad. Therefore, the conductive path from each part of the first side plate part 54 and the second side plate part 154 to the reference potential trace is short, improving the shielding properties of each part of the first side plate part 54 and the second side plate part 154. Moreover, the first substrate and the second substrate are more assuredly connected, preventing deformation of the first reinforcing bracket 51 and the second reinforcing bracket 151.

Moreover, the shield plate 56 is held in the center in the width direction of the first projection 13 and spaced distal from the first terminals 61 and the second terminal 161 in the recessed grooves 12*a* on both sides in the width direction of the first projection 13. Because the interval between the shield plate 56 and the first terminal 61 and the second terminal 161 is maintained in this manner, even if a transmission line of a signal from the first tail part 62 of the first terminal 61 to the second tail part 162 of the second terminal 161 is used in transmitting a high frequency signal, the shield plate 56 and the first terminal 61 and the second terminal 161 can be prevented from interfering with each other and operating as an antenna. Further, the first side gap 58 is present between the first side plate part 54 (also functioning as a shield) and the first side wall part 14 (with the first terminals 61 installed therein). Because the interval between the first side plate part 54 and the first terminals 61 is maintained in this manner, even if the transmission line is used in transmitting high frequency signals, the first side plate part 54 and the first terminals 61 can be prevented from interfering with each other and operating as an antenna. Similarly, the second side gap 158 is present between the second side plate part 154 (also functioning as a shield) and the second side wall part 112 (with the second terminals 161 installed therein). Because the interval between the second side plate part 154 and the second terminal 161 is maintained in this manner, even if the transmission line is used in transmitting the high frequency signal, the second side plate part 154 and the second terminal 161 can be prevented from interfering with each other and operating as an antenna.

Furthermore, when the first connector 1 mates with the second connector 101, the first side wall part 14 of the first housing 11 is inserted into the second side gap 158 of the second housing 111. As a result, the inner side face of the second side plate part 154 along with the outer side face 112*d* of the second side wall part 112 of the second connector 101 are respectively approached or contacted with the outer side face 14*d* and the inner side face of the first side wall part 14 of the first connector 1, making it possible to prevent backlash of the first connector 1 and the second connector 101 which mate with each other.

In this manner, in the present embodiment, the connector assembly includes: the first connector 1 which includes the first housing 11, the first terminals 61 installed in the first housing 11, and the first reinforcing bracket 51 installed in the first housing 11; and the second connector 101 which includes the second housing 111, the second terminals 161 installed in the second housing 111, and the second reinforcing bracket 151 installed in the second housing 111, and mates with the first connector 1. In addition, the first housing 11 includes: a first recess 12 mating with the second housing 111; a first side wall part 14 extending in the longitudinal direction so as to define both sides of the first recess 12; and a first projection 13 extending in the longitudinal direction in the first recess 12 so as to mate with a recessed groove 113 of the second housing 111, the first terminal 61 includes a first contact part 65*a* contacting the second terminal 161 in a recessed groove 12*a* between the first projection 13 and the first side wall part 14, the first connector 1 further includes a shield plate 56 which is held in the center in the width direction of the first projection 13 so as to extend in the longitudinal direction, the second reinforcing bracket 151 includes a second central connection foot 152*d* connected to the reference potential trace, and an end wall inner cover part 152*b* contacting both ends in the longitudinal direction of the shield plate 56, and the second connector 101 includes a ground terminal 171 which includes a ground tail part 172 connected to the reference potential trace along with a ground contact part 175*a* contacting the middle in the longitudinal direction of the shield plate 56.

As a result, both ends in the longitudinal direction of the shield plate 56, which are provided in the center in the width direction of the first projection 13 so as to extend in the longitudinal direction, are connected to the reference potential trace, while the middle in the longitudinal direction is connected to the reference potential trace via the ground terminal 171. Therefore, the connector assembly can reduce the span of the conductive path from a shield plate provided between rows of the first terminals 61 and the second terminal 161 to a reference potential trace, thereby obtaining high shield effects and improving reliability.

Moreover, the second housing 111 includes the second side wall part 112 extending in the longitudinal direction so as to define both sides of the recessed groove 113, while the ground terminal 171 includes the ground holding part 173 held by the second side wall part 112 along with the ground connection part 174 extending from the ground holding part 173 in the width direction, with the ground contact part 175*a* connected to the free end of the ground connection part 174. Further, the second terminal 161 is arranged in plural in the longitudinal direction so as to be provided on the second side wall part 112, while the ground holding part 173 of the ground terminal 171 is disposed between the second terminals 161 arranged in the longitudinal direction. Therefore, because the shield plate 56 is connected to the reference potential trace via the ground connection part 174 extending in the width direction, the span of the conductive path to the reference potential trace is very short.

Further, the second reinforcing bracket 151 includes: a second body part 152 formed on both ends in the longitudinal direction; and a second side plate part 154 extending in the longitudinal direction, with both ends thereof connected to the second body part 152, wherein the second central connection foot 152*d* is connected to the outer end of the second body part 152, while the end wall inner cover part 152*b* is connected to the inner end of the second body parts 152. Therefore, the span of the conductive path from both ends in the longitudinal direction of the shield plate 56 to the reference potential trace can be reduced.

Further, the second side plate part 154 is spaced distal from the outer side face 112*d* of the second side wall part 112 of the second housing 111. Therefore, the second side plate part 154 and the second terminal 161 can be prevented from interfering with each other and operating as an antenna.

Further, the first reinforcing bracket 51 includes: a first body part 52 formed on both ends in the longitudinal direction; and a first side plate part 54 extending in the longitudinal direction, with both ends thereof connected to the first body part 52, wherein this first side plate part 54 includes an engagement swollen part 54*c* which swells to the center in the width direction so as to be engageable with an engagement recess 154*a* formed in the second side plate part 154. Consequently, the first reinforcing bracket 51 and the second reinforcing bracket 151 can be assuredly contacted and maintained, while the reference potential trace of the first substrate, the reference potential trace of the second substrate, the first reinforcing bracket 51, the second reinforcing bracket 151, and the shield plate 56 are equipotential, thereby improving the shielding properties.

Next Embodiment 2 will be described. Note that the description of elements having the same structures as those of Embodiment 1 will be omitted by being denoted by the same reference numerals. Furthermore, a description of operations and effects that are the same as those of Embodiment 1 will be omitted.

Figure 8:
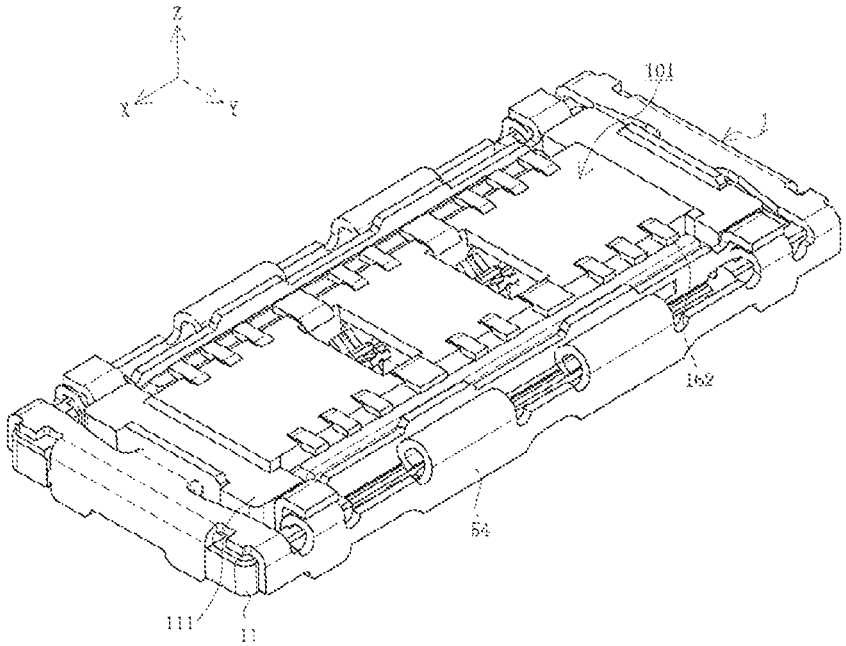
FIG. 8 is a perspective view of the state in which a first connector and a second connector according to Embodiment 2 are mated.
Figure 9:
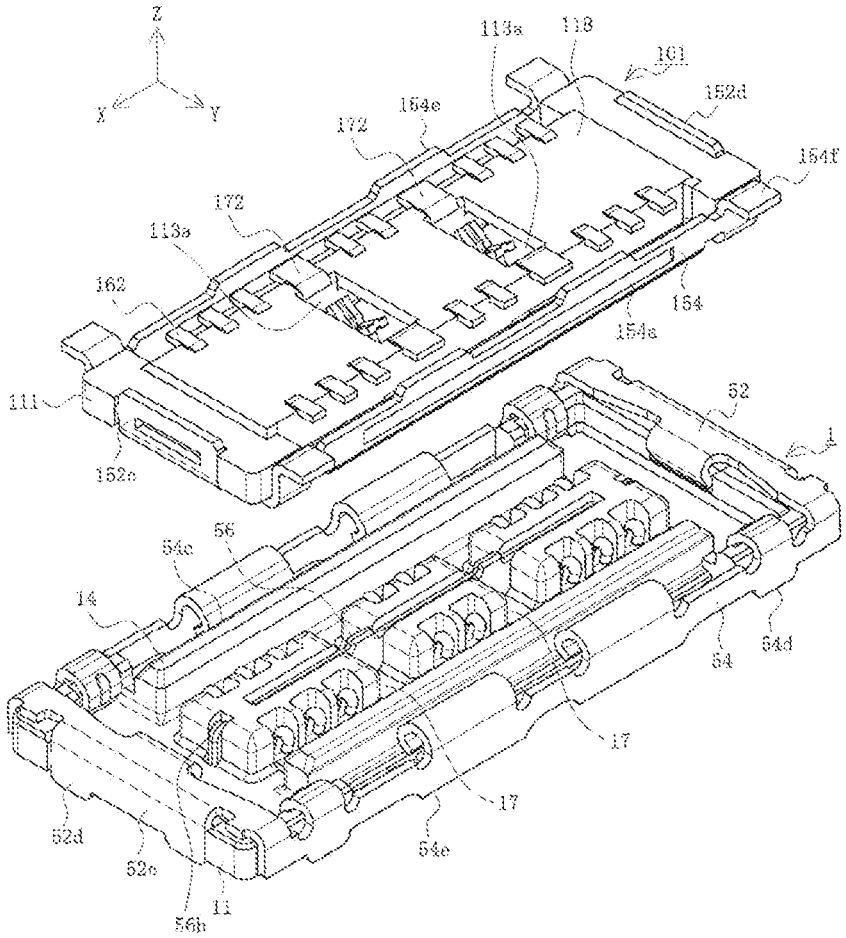
FIG. 9 is a perspective view of the first connector and the second connector according to Embodiment 2 prior to mating.
Figure 10:
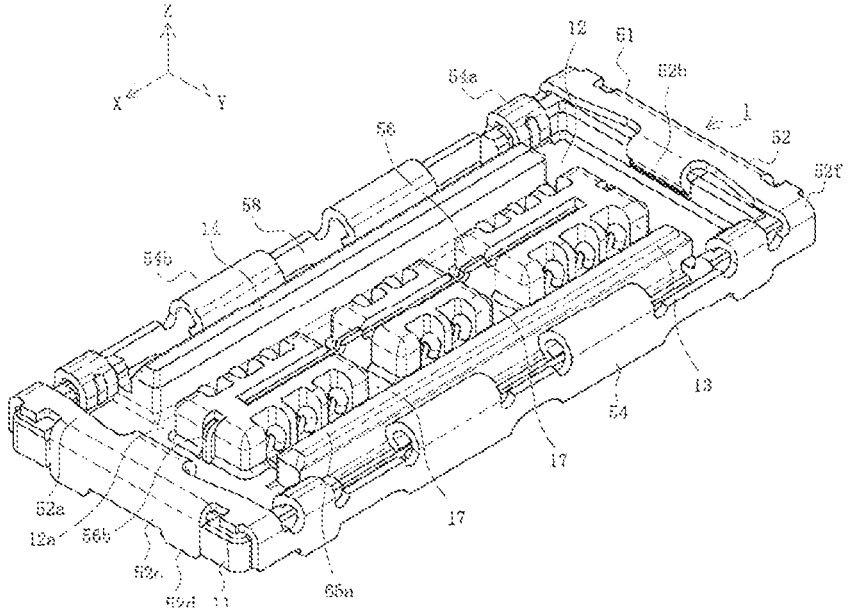
FIG. 10 is a perspective view of the first connector according to Embodiment 2.
Figure 11:
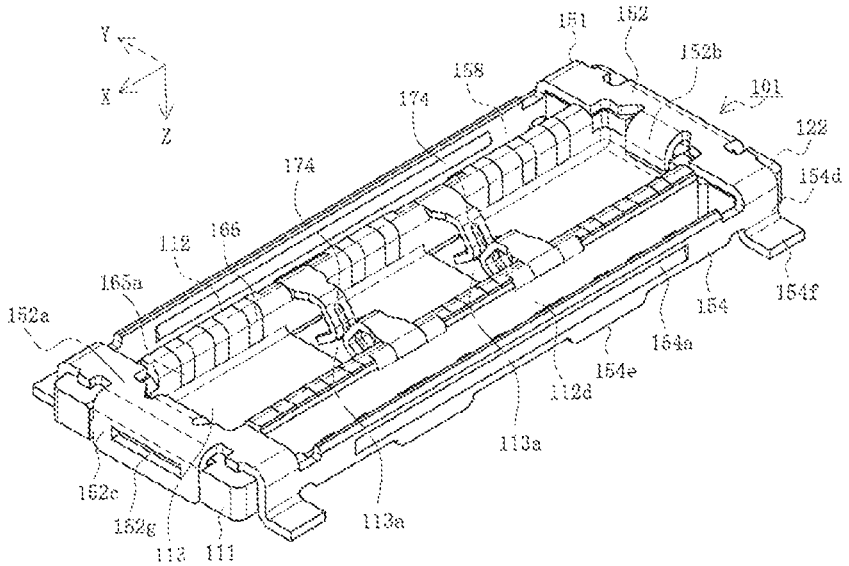
FIG. 11 is a perspective view of the second connector according to Embodiment 2.
Figure 12:
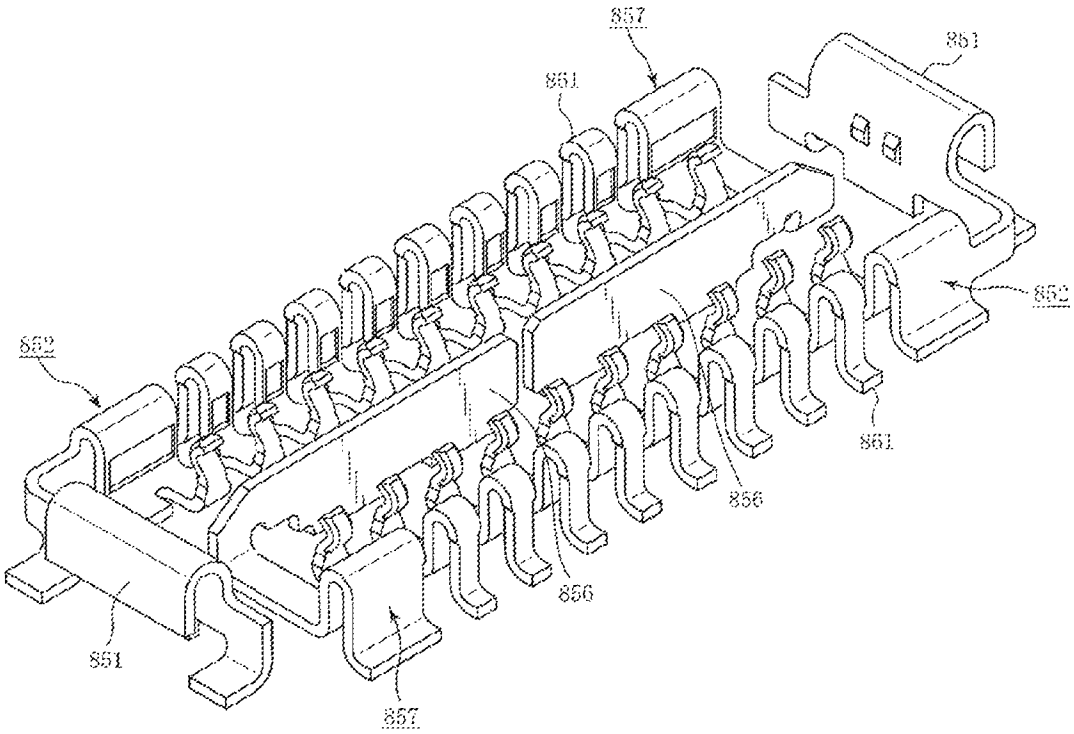
FIG. 12 is a perspective view illustrating a conventional terminal and shield member.

FIG. 8 is a perspective view of the state in which a first connector and a second connector according to Embodiment 2 are mated, FIG. 9 is a perspective view of the first connector and the second connector according to Embodiment 2 prior to mating, FIG. 10 is a perspective view of the first connector according to Embodiment 2, and FIG. 11 is a perspective view of the second connector according to Embodiment 2.

The dimensions in the longitudinal direction (X axis direction) of a first connector 1 and a second connector 101 in the present embodiment are set to be larger than those in Embodiment 1. Accordingly, the dimensions in the longitudinal direction of a first housing 11, a second housing 111, a first reinforcing bracket 51, a second reinforcing bracket 151, and a shield plate 56 are set to be larger than those in Embodiment 1. Moreover, the number of first terminals 61 and second terminals 161 is increased compared with Embodiment 1.

In addition, a first projection 13 of the first housing 11 is divided into three in the longitudinal direction by two splitting groove parts 17, while the shield plate 56 is exposed in the two splitting groove parts 17. Moreover, first terminal housing cavities 15 are formed on both sides of each first projection 13, for example, in the number of three, two, and three at the same pitch as in Embodiment 1.

Note, since the other points of the configuration of the first connector 1 according to the present embodiment are the same as in Embodiment 1, a description thereof is omitted.

In the second connector 101, a ground terminal 171 is provided at each position corresponding to the two splitting groove parts 17, while the second terminals 161 are provided at each position corresponding to the first terminals 61 housed in the first terminal housing cavities 15. Moreover, two openings 113*a* may be formed at each position corresponding to the ground terminal 171 in the bottom plate 118 of the second housing 111. Further, a connection tail 154*f* having a substantially L shaped cross section may be connected to the lower end of a double end side connection foot 154*d* stretching downward from a position corresponding to a part connected to a curved connection part 152*f* at the lower end of a second side plate part 154 so as to externally stretch in the width direction of the second housing 111. The double end side connection foot 154*d* may be connected to a connection pad coupled to a reference potential trace such as a power trace or ground trace of a second substrate by soldering, etc. Alternatively, if the connection tail 154*f* is connected to the lower end of the double end side connection foot 154*d*, the connection tail 154*f*, instead of the double end side connection foot 154*d*, may be connected to the connection pad.

Note, since the other points of the configuration of the second connector 101 according to the present embodiment are the same as in Embodiment 1, descriptions thereof are omitted.

In the present embodiment, the dimensions in the longitudinal direction of the first connector 1 and the second connector 101 are set to be large, with the dimensions in the longitudinal direction of the shield plate 56 also set to be large. Accordingly, multiple locations of the shield plate 56 in the longitudinal direction contact the ground terminal 171, allowing the conductive path from each part of the shield plate 56 to the reference potential trace to be maintained short, with high shielding properties in each part of the shield plate 56 capable of being maintained.

In this manner, in the present embodiment, the ground terminal 171 is disposed at multiple locations in the longitudinal direction. Therefore, even if the dimensions in the longitudinal direction of the first connector 1 and the second connector 101 are large and the shield plate 56 is long, the conductive path from each part of the shield plate 56 to the reference potential trace can be reduced, thereby allowing the maintenance of high shielding properties.

Note that the disclosure of the present specification describes characteristics related to a preferred and exemplary embodiment. Various other embodiments, modifications, and variations within the scope and spirit of the claims appended hereto could naturally be conceived of by persons skilled in the art by summarizing the disclosures of the present specification.

The present disclosure can be applied to connector assemblies.

The invention claimed is:

1. A connector assembly, comprising:

a first connector which includes a first connector body, a first terminal mounted on the first connector body, and a first reinforcing bracket mounted on the first connector body; and a second connector which includes a second connector body, a second terminal mounted on the second connector body, and a second reinforcing bracket mounted on the second connector body, the second connector configured to be mated with the first connector, wherein the first reinforcing bracket has a first body part and a first side plate part, the first body part having a first body upper face part, a first end wall inner cover part which extends from an inner edge of the first body upper face part, and a first end wall outer cover part which extends from an outer edge of the first body upper face part, the first side plate part extending from an end of the first body upper face part, the first side plate part having a first contact part which extends from the first side plate part proximate to the first body part, wherein the first reinforcing bracket further comprises a first connection foot which extends from an end of at least one of the first end wall outer cover part and the first side plate part, wherein the second reinforcing bracket has a second body part and a second side plate part, the second body part having a second body upper face part, a second end wall inner cover part which extends from an inner edge of the second body upper face part, and a second end wall outer cover part which extends from an outer edge of the second body upper face part, the second side plate part extending from an end of the second body upper face part, wherein the second reinforcing bracket further comprises a second connection foot which extends from an end of the second side plate part, wherein the first end wall inner cover part is configured to contact the second end wall outer cover part, and wherein at least one of the first connection foot and the first contact part are configured to contact the second side plate part.

2. The connector assembly as defined in claim 1, wherein the first connection foot extends from an end of each of the first end wall outer cover part and the first side plate part, and wherein the second connection foot extends from an end of each of the second end wall outer cover part and the second side plate part.

3. The connector assembly as defined in claim 1, wherein the first connector body has a recess, a first side wall part extending in a longitudinal direction so as to define both sides of the recess, and a projection extending in the longitudinal direction of the recess, the first side wall part being separated from the first body part.

4. The connector assembly as defined in claim 3, wherein a space is defined between the first side wall part and the first side plate part, and wherein the second side plate part is configured to be positioned within the space.

5. The connector assembly as defined in claim 3, wherein the second connector body has a second side wall extending in a longitudinal direction, wherein a space is defined between the second side wall and the second side plate part, and wherein the first side wall part is configured to be positioned within the space.

6. A connector assembly, comprising:

a first connector which includes a first connector body, a first terminal mounted on the first connector body, a first reinforcing bracket mounted on the first connector body, and a projection; and a second connector which includes a second connector body, a second terminal mounted on the second connector body, a second reinforcing bracket mounted on the second connector body, and a groove, wherein the second reinforcing bracket includes a pair of second body parts, wherein each of the second body parts include a second body upper face part which covers the majority of the upper face of the second end wall of the second housing, and curved connection parts extended downward from both ends of the second body upper face part, wherein the first reinforcing bracket includes a pair of first body parts, and a pair of first side plate parts which couple the pair of first body parts, wherein each of the first body parts include a first body upper face part which covers the majority of the upper face of the first end wall of the first housing of the first connector body, wherein the first side plate part include double end side contact parts, wherein one end thereof is connected to the upper end of the first side plate part at both ends in the longitudinal direction of the first side plate part, and the other end as a free end extends downward, and wherein the second connector mates with the first connector, and when mating, the projection of the first connector mates with the groove of the second connector, and the double end side contact parts of the first reinforcing bracket contact the curved connection parts of the second reinforcing bracket.

7. The connector assembly according to claim 6, wherein the first reinforcing bracket further includes an end wall inner cover part which extends downward and protrudes towards the center in the longitudinal direction of the first housing from the inner end edge of the first body upper face part, wherein the second body part further includes a second end wall outer cover part which extends from the outer edge of the second body upper face part, and when mating, the end wall inner cover part of the first reinforcing bracket contacts the second end wall outer cover part of the second reinforcing bracket.

8. The connector assembly according to claim 7, wherein the end wall inner cover part the first reinforcing bracket further includes an engagement swollen part, and the engagement swollen part contacts the second end wall outer cover part of the second reinforcing bracket.

9. The connector assembly according to claim 7, wherein the second end wall outer cover part further includes a second connection foot which extends from the lower end of the second end wall outer cover part.

10. The connector assembly according to claim 6, wherein the second terminal, which is over-molded or insert-molded into the second housing of the second connector body, includes a second connecting part and a second tail part, wherein the second connecting part includes a second contact part, and wherein one surface of the second contact part faces to the groove, and wherein the second connecting part is formed in U-shape as seen in the longitudinal direction of the second housing.

11. The connector assembly according to claim 6, wherein each of the double end side contact parts of the first reinforcing bracket are members curved in U-shape as seen in the longitudinal direction of the first housing.

12. A second connector, comprising:

a second connector body, a second terminal mounted on the second connector body, a second reinforcing bracket mounted on the second connector body, and a groove, wherein the second reinforcing bracket includes a pair of second body parts, wherein each of the second body parts include a second body upper face part which covers the majority of the upper face of the second end wall of the second housing, and curved connection parts extended downward from both ends of the second body upper face part, and wherein the second terminal, which is over-molded or insert-molded into the second housing of the second connector body, includes a second connecting part and a second tail part, wherein the second connecting part includes a second contact part, and wherein one surface of the second contact part faces to the groove.

13. A connector assembly, which includes a second connector according to claim 12, comprising:

a first connector which includes a first connector body, a first terminal mounted on the first connector body, a first reinforcing bracket mounted on the first connector body, and a recessed groove, wherein the first reinforcing bracket includes a pair of first body parts, wherein each of the first body parts include a first body upper face part which covers the majority of the upper face of the first end wall of the first housing of the first connector body, and wherein the second connector mates with the first connector, and when mating, the recessed groove of the first connector mates with a wall of the second connector on which the second terminal mounted, and the first reinforcing bracket contact the second reinforcing bracket.

* * * * *